US007740414B2

(12) United States Patent
Hall et al.

(10) Patent No.: US 7,740,414 B2
(45) Date of Patent: Jun. 22, 2010

(54) MILLING APPARATUS FOR A PAVED SURFACE

(76) Inventors: David R. Hall, 2185 S. Larsen Pkwy., Provo, UT (US) 84606; Ronald Crockett, 2185 S. Larsen Pkwy., Provo, UT (US) 84606

( * ) Notice: Subject to any disclaimer, the term of this patent is extended or adjusted under 35 U.S.C. 154(b) by 362 days.

(21) Appl. No.: 11/934,245

(22) Filed: Nov. 2, 2007

(65) Prior Publication Data

US 2008/0063476 A1 Mar. 13, 2008

Related U.S. Application Data

(63) Continuation-in-part of application No. 11/673,634, filed on Feb. 12, 2007, and a continuation-in-part of application No. 11/668,254, filed on Jan. 29, 2007, now Pat. No. 7,353,893, which is a continuation-in-part of application No. 11/553,338, filed on Oct. 26, 2006, now Pat. No. 7,665,552, application No. 11/934,245, which is a continuation-in-part of application No. 11/164,947, filed on Dec. 12, 2005, now Pat. No. 7,544,011, which is a continuation-in-part of application No. 11/163,615, filed on Oct. 25, 2005, now Pat. No. 7,473,052, which is a continuation-in-part of application No. 11/070,411, filed on Mar. 1, 2005, now Pat. No. 7,223,049.

(51) Int. Cl.
*E01C 23/00* (2006.01)

(52) U.S. Cl. ..... 404/82; 404/94

(58) Field of Classification Search ..... 404/83–94
See application file for complete search history.

(56) References Cited

U.S. PATENT DOCUMENTS 1,887,341 A 11/1932 Venable
1,898,158 A 2/1933 Winkle
2,004,315 A 6/1935 Fean (Continued)

FOREIGN PATENT DOCUMENTS

DE 3500261 7/1986

(Continued)

OTHER PUBLICATIONS

U.S. Appl. No. 11/421,105, May 31, 2006, Hall.

*Primary Examiner*—Raymond W Addie
(74) *Attorney, Agent, or Firm*—Tyson J. Wilde; Jad A. Mills

(57) ABSTRACT

In one aspect of the invention, an apparatus for directional degradation of a surface comprises an attachment assembly connected to a motorized vehicle comprising at least one degradation tool. The at least one degradation tool comprises a substantially cylindrical rotary degradation element having a substantially cylindrical working surface formed about a rotational axis. A plurality of cutting inserts is embedded within the substantially cylindrical working surface and is adapted to degrade a surface in a direction substantially normal to the rotational axis. At least one of the plurality of cutting inserts comprises a superhard material bonded to a cemented metal carbide substrate at a non-planar interface. The superhard material comprises a substantially pointed geometry with an apex comprising a 0.050 to 0.160 inch radius and a 0.100 to 0.500 inch thickness from the apex to the non-planar interface.

19 Claims, 11 Drawing Sheets

U.S. PATENT DOCUMENTS

| | | | |
|---|---|---|---|
| 2,039,078 | A | 4/1936 | Hertwig |
| 2,098,895 | A | 11/1937 | Velten |
| 2,124,438 | A | 7/1938 | Struk |
| 2,633,782 | A | 4/1953 | Clement |
| 2,893,299 | A | 7/1959 | Moir |
| 2,908,206 | A | 10/1959 | Melanson |
| 2,938,438 | A | 5/1960 | Hamilton |
| 3,075,436 | A | 1/1963 | McRae |
| 3,254,392 | A | 6/1966 | Novkov |
| 3,361,042 | A | 1/1968 | Cutler |
| 3,732,023 | A | 5/1973 | Rank |
| 3,746,396 | A | 7/1973 | Radd |
| 3,807,804 | A | 4/1974 | Kniff |
| 3,817,644 | A | 6/1974 | Matson |
| 3,830,321 | A | 8/1974 | McKenny |
| 3,932,952 | A | 1/1976 | Helton |
| 3,945,681 | A | 3/1976 | White |
| 3,970,404 | A | 7/1976 | Benedetti |
| 3,989,401 | A | 11/1976 | Moench |
| 4,005,914 | A | 2/1977 | Newman |
| 4,006,936 | A | 2/1977 | Crabiel |
| 4,018,540 | A | 4/1977 | Jackson |
| 4,098,382 | A | 7/1978 | Bonnice |
| 4,104,736 | A | 8/1978 | Mendenhall |
| 4,109,737 | A | 8/1978 | Bovenkerk |
| 4,124,325 | A | 11/1978 | Cutler |
| 4,127,351 | A | 11/1978 | Vural |
| 4,156,329 | A | 5/1979 | Danie's |
| 4,172,679 | A | 10/1979 | Wirtgen |
| 4,195,946 | A | 4/1980 | Swisher |
| 4,199,035 | A | 4/1980 | Thompson |
| 4,201,421 | A | 5/1980 | Den Besten |
| 4,215,940 | A | 8/1980 | Gabriel |
| 4,261,669 | A | 4/1981 | Sindelar |
| 4,277,106 | A | 7/1981 | Sahley |
| 4,313,690 | A | 2/1982 | Hojbjerg |
| 4,335,975 | A | 6/1982 | Schoelkopf |
| 4,347,016 | A | 8/1982 | Larsen |
| 4,407,605 | A | 10/1983 | Chiostri |
| 4,439,250 | A | 3/1984 | Acharya |
| 4,465,221 | A | 8/1984 | Schmidt |
| 4,473,320 | A | 9/1984 | Register |
| 4,484,644 | A | 11/1984 | Cook |
| 4,489,986 | A | 12/1984 | Dziak |
| 4,534,674 | A | 8/1985 | Cutler |
| 4,594,022 | A | 6/1986 | Jeppson |
| 4,668,017 | A | 5/1987 | Petersen |
| 4,676,689 | A | 6/1987 | Yant |
| 4,678,237 | A | 7/1987 | Collin |
| 4,682,987 | A | 7/1987 | Brady |
| 4,688,856 | A | 8/1987 | Elfgen |
| 4,692,350 | A | 9/1987 | Clarke |
| 4,725,098 | A | 2/1988 | Beach |
| 4,729,603 | A | 3/1988 | Elfgen |
| 4,765,686 | A | 8/1988 | Adams |
| 4,765,687 | A | 8/1988 | Parrott |
| 4,778,862 | A | 10/1988 | Wand |
| 4,784,518 | A | 11/1988 | Cutler |
| 4,793,730 | A | 12/1988 | Butch |
| 4,880,154 | A | 11/1989 | Tank |
| 4,932,723 | A | 6/1990 | Mills |
| 4,940,288 | A | 7/1990 | Stiffler |
| 4,944,559 | A | 7/1990 | Sionnet |
| 4,951,762 | A | 8/1990 | Lundell |
| 4,968,101 | A | 11/1990 | Bossow |
| 5,011,515 | A | 4/1991 | Frushour |
| 5,112,165 | A | 5/1992 | Hedlund |
| 5,131,788 | A | 7/1992 | Hulicsko |
| 5,141,289 | A | 8/1992 | Stiffler |
| 5,154,245 | A | 10/1992 | Waldenstrom |
| 5,186,892 | A | 2/1993 | Pope |
| 5,251,964 | A | 10/1993 | Ojanen |
| 5,303,785 | A * | 4/1994 | Duke ..... 175/57 |
| 5,332,348 | A | 7/1994 | Lemelson |
| 5,366,320 | A | 11/1994 | Hanlon |
| 5,417,475 | A | 5/1995 | Graham |
| 5,447,208 | A | 9/1995 | Lund |
| 5,535,839 | A | 7/1996 | Brady |
| 5,542,993 | A | 8/1996 | Rabinkin |
| 5,556,225 | A | 9/1996 | Marino |
| 5,653,300 | A | 8/1997 | Lund |
| 5,738,698 | A | 4/1998 | Kapoor |
| 5,765,926 | A | 6/1998 | Knapp |
| 5,791,814 | A | 8/1998 | Wiley |
| 5,823,632 | A | 10/1998 | Burkett |
| 5,837,071 | A | 11/1998 | Anderson |
| 5,845,547 | A | 12/1998 | Sollami |
| 5,875,862 | A | 3/1999 | Jurewicz |
| 5,934,542 | A | 8/1999 | Nakamura |
| 5,935,718 | A | 8/1999 | Demo |
| 5,944,129 | A | 8/1999 | Jenson |
| 5,947,636 | A | 9/1999 | Mara |
| 5,947,638 | A | 9/1999 | Helms |
| 5,951,561 | A | 9/1999 | Pepper |
| 5,967,250 | A | 10/1999 | Lund |
| 5,992,405 | A | 11/1999 | Sollami |
| 6,006,846 | A | 12/1999 | Tibbitts |
| 6,019,434 | A | 2/2000 | Emmerich |
| 6,044,920 | A | 4/2000 | Massa |
| 6,051,079 | A | 4/2000 | Andersson |
| 6,056,911 | A | 5/2000 | Griffin |
| 6,065,552 | A | 5/2000 | Scott |
| 6,113,195 | A | 9/2000 | Mercier |
| 6,122,601 | A | 9/2000 | Swanson |
| 6,158,920 | A | 12/2000 | Malot |
| 6,170,917 | B1 | 1/2001 | Heinrich |
| 6,193,770 | B1 | 2/2001 | Sung |
| 6,196,636 | B1 | 3/2001 | Mills |
| 6,196,910 | B1 | 3/2001 | Johnson |
| 6,199,956 | B1 | 3/2001 | Kammerer |
| 6,216,805 | B1 | 4/2001 | Lays |
| 6,270,165 | B1 | 8/2001 | Peay |
| 6,287,048 | B1 | 9/2001 | Hollon |
| 6,341,823 | B1 | 1/2002 | Sollami |
| 6,354,771 | B1 | 3/2002 | Bauschulte |
| 6,364,420 | B1 | 4/2002 | Sollami |
| 6,371,567 | B1 | 4/2002 | Sollami |
| 6,371,689 | B1 | 4/2002 | Wiley |
| 6,375,272 | B1 | 4/2002 | Ojanen |
| 6,419,278 | B1 | 7/2002 | Cunningham |
| 6,478,383 | B1 | 11/2002 | Ojanen |
| 6,499,547 | B2 | 12/2002 | Scott |
| 6,517,902 | B2 | 2/2003 | Drake |
| 6,551,018 | B2 | 4/2003 | Baker |
| 6,577,141 | B2 | 6/2003 | Gandrud |
| 6,585,326 | B2 | 7/2003 | Sollami |
| 6,623,207 | B2 | 9/2003 | Grubba |
| 6,685,273 | B1 | 2/2004 | Sollami |
| 6,692,083 | B2 | 2/2004 | Latham |
| 6,709,065 | B2 | 3/2004 | Peay |
| 6,719,074 | B2 | 4/2004 | Tsuda |
| 6,733,087 | B2 | 5/2004 | Hall |
| 6,739,327 | B2 | 5/2004 | Sollami |
| 6,758,530 | B2 | 7/2004 | Sollami |
| 6,769,836 | B2 | 8/2004 | Lloyd |
| 6,786,557 | B2 | 9/2004 | Montgomery, Jr. |
| 6,799,922 | B2 | 10/2004 | Smith |
| 6,824,225 | B2 | 11/2004 | Stiffler |
| 6,846,354 | B2 | 1/2005 | Larsen |
| 6,851,758 | B2 | 2/2005 | Beach |
| 6,854,810 | B2 | 2/2005 | Montgomery, Jr. |
| 6,861,137 | B2 | 3/2005 | Griffin |
| 6,889,890 | B2 | 5/2005 | Yamazaki et al. |
| 6,966,611 | B1 | 11/2005 | Sollami |

| | | | |
|---|---|---|---|
| 6,994,404 | B1 | 2/2006 | Sollami |
| 7,204,560 | B2 | 4/2007 | Mercier |
| 2002/0175555 | A1 | 11/2002 | Mercier |
| 2003/0140350 | A1 | 7/2003 | Noro |
| 2003/0209366 | A1 | 11/2003 | McAlvain |
| 2003/0234280 | A1 | 12/2003 | Cadden |
| 2004/0026983 | A1 | 2/2004 | McAlvain |
| 2004/0065484 | A1 | 4/2004 | McAlvain |
| 2005/0159840 | A1 | 7/2005 | Lin |
| 2005/0173966 | A1 | 8/2005 | Mouthaan |
| 2006/0237236 | A1 | 10/2006 | Sreshta |

FOREIGN PATENT DOCUMENTS

| | | |
|---|---|---|
| DE | 3818213 | 11/1989 |
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| GB | 2004315 | 3/1979 |
| GB | 2037223 | 11/1979 |
| JP | 3123193 | 1/2001 |

* cited by examiner

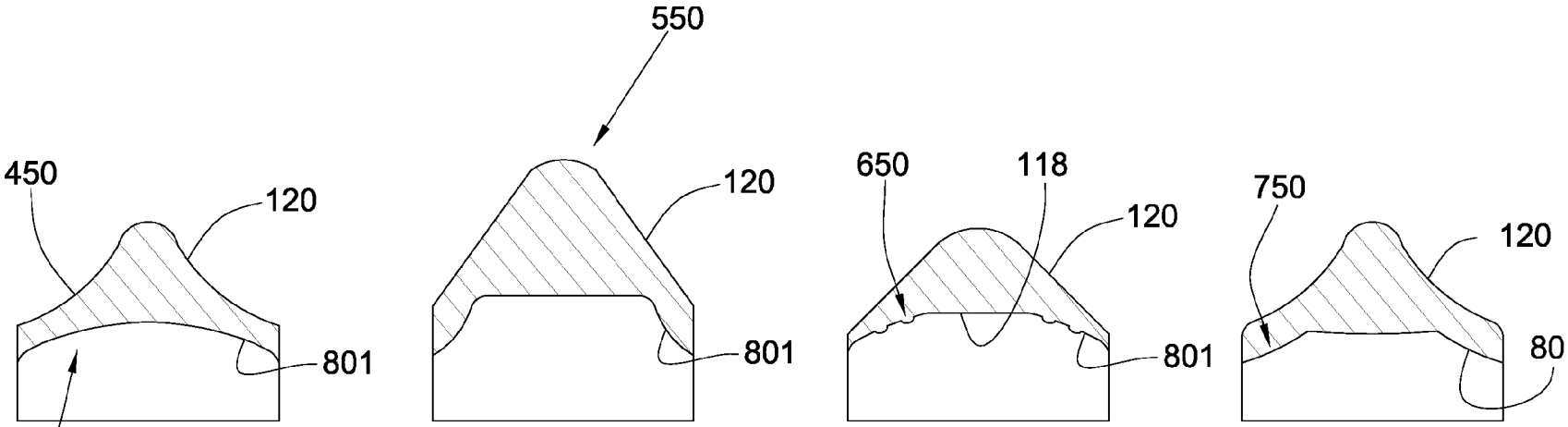
Fig. 12
Fig. 13
Fig. 14
Fig. 15
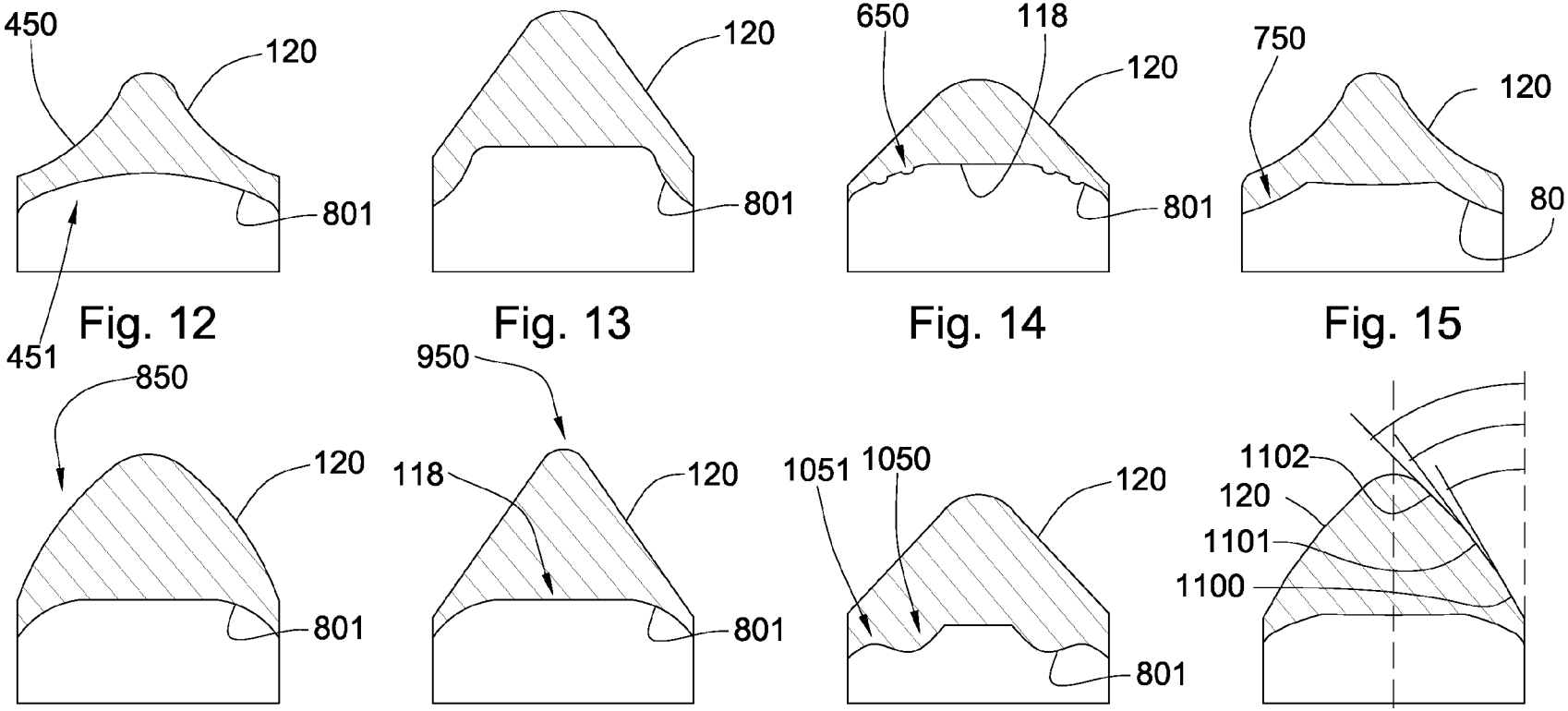
Fig. 16
Fig. 17
Fig. 18
Fig. 19

MILLING APPARATUS FOR A PAVED SURFACE

CROSS REFERENCE TO RELATED APPLICATIONS

This application is a continuation-in-part of U.S. patent application Ser. No. 11/673,634 which was filed on Feb. 12, 2007 and was a continuation-in-part of U.S. patent application Ser. No. 11/668,254, now U.S. Pat. No. 7,353,893, which was filed on Jan. 29, 2007. U.S. patent application Ser. No. 11/668,254 is a continuation-in-part of U.S. patent application Ser. No. 11/553,338, now U.S. Pat. No. 7,665,552, which was filed on Oct. 26, 2006. This application is also a continuation-in-part of U.S. patent application Ser. No. 11/164,947, now U.S. Pat. No. 7,544,011, which was filed on Dec. 12, 2005. U.S. patent application Ser. No. 11/164,947, now U.S. Pat. No. 7,544,011, is a continuation-in-part of U.S. patent application Ser. No. 11/163,615, now U.S. Pat. No. 7,473,052, filed on Oct. 25, 2005. U.S. patent application Ser. No. 11/163,615 is a continuation-in-part of U.S. patent application Ser. No. 11/070,411 filed on Mar. 1, 2005, now U.S. Pat. No. 7,223,049. All of the above mentioned U.S. patent applications are herein incorporated by reference for all that they contain.

BACKGROUND OF THE INVENTION

Modern road surfaces typically comprise asphalt, macadam, or other bituminous material processed and applied to form a smooth paved surface. Where low quality pavement components are used, or where pavement components are improperly implemented or combined, the paved surface may deteriorate quickly, necessitating frequent maintenance and repair. Even under normal conditions, temperature fluctuations, weather, and vehicular traffic over the paved surface may result in cracks and other surface irregularities over time. Road salts and other corrosive chemicals applied to the paved surface, as well as accumulation of water in surface cracks, may accelerate pavement deterioration. In some situations, concrete roads may shift due to the earth shifting under them.

Road resurfacing equipment may be used to degrade, remove, plane and/or recondition deteriorated pavement. Typically, heat generating equipment is used to soften the pavement, followed by equipment to degrade and plane the surface. New pavement materials may be worked into the degraded surface to recondition the pavement. The mixture may then be compacted to restore a smooth paved surface.

BRIEF SUMMARY OF THE INVENTION

In one aspect of the invention, an apparatus for directional degradation of a surface comprises an attachment assembly connected to a motorized vehicle comprising at least one degradation tool. The at least one degradation tool comprises a substantially cylindrical rotary degradation element having a substantially cylindrical working surface formed about a rotational axis. A plurality of cutting inserts is embedded within the substantially cylindrical working surface and is adapted to degrade a surface in a direction substantially normal to the rotational axis. At least one of the plurality of cutting inserts comprises a superhard material bonded to a cemented metal carbide substrate at a non-planar interface. The superhard material comprises a substantially pointed geometry with an apex comprising a 0.050 to 0.160 inch radius and a 0.100 to 0.500 inch thickness from the apex to the non-planar interface.

In some embodiments the thickness may be 0.125 to 0.275 inches. The superhard material and the substrate may comprise a total thickness of 0.200 to 0.700 inches from the apex to a base of the substrate. The substrate may comprise a height that is less than one-half the total thickness of the insert. Each of the plurality of inserts may comprise a substrate diameter and each insert may be disposed within a distance equal to its own substrate diameter to at least one other insert.

The superhard material may comprise a substantially conical surface having a side which forms a 35 to 55 degree angle with a central axis of the cutting insert. In some embodiments the angle may be substantially 45 degrees. The substantially pointed geometry of the superhard material may comprise a convex or a concave side. The superhard material may comprise diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The superhard material may be a polycrystalline structure with an average grain size of 1 to 100 microns. In some embodiments a volume of the superhard material may be 75 to 150 percent of a volume of the carbide substrate.

The cutting insert may be disposed on the substantially cylindrical working surface. The cutting insert may be brazed or press fit to the degradation element. The substrate may be attached to blades formed on the outer surface of the cylindrical rotary degradation element. In some embodiments the substrate may comprise a tapered surface at the interface starting from a cylindrical rim of the substrate and ending at an elevated flatted central region formed in the substrate. The flatted region may comprise a diameter of 0.125 to 0.250 inches. In some embodiments the working surface may be adapted to angularly contact the surface to be degraded at a negative rake angle. The negative rake angle may be from 0.1° to 60°.

In another aspect of the invention a degradation drum comprises a generally cylindrical body having a plurality of degradation assemblies disposed on an outer diameter. At least one of the plurality of degradation assemblies comprises a pick having a shank disposed in a holder and an impact tip opposite the shank. The impact tip has a superhard material bonded to a metal carbide substrate at a non-planar interface. The superhard material has a substantially pointed geometry with an apex comprising a 0.050 to 0.160 inch radius and a 0.100 to 0.500 inch thickness from the apex to the non-planar interface. The holder of each of the plurality of degradation assemblies contacts the holder of at least one other assembly.

BRIEF DESCRIPTION OF THE DRAWINGS

FIG. 12 is cross-sectional diagram of another embodiment of a cutting insert.

FIG. 13 is cross-sectional diagram of another embodiment of a cutting insert.

FIG. 14 is cross-sectional diagram of another embodiment of a cutting insert.

FIG. 15 is cross-sectional diagram of another embodiment of a cutting insert.

FIG. 16 is cross-sectional diagram of another embodiment of a cutting insert.

FIG. 17 is cross-sectional diagram of another embodiment of a cutting insert.

FIG. 18 is cross-sectional diagram of another embodiment of a cutting insert.

FIG. 19 is cross-sectional diagram of another embodiment of a cutting insert.

DETAILED DESCRIPTION OF THE INVENTION AND THE PREFERRED EMBODIMENT

In this application, the terms "pavement" and "paved surface" are used interchangeably and refer to any artificial, wear-resistant surface that facilitates vehicular, pedestrian, or other form of traffic. Pavement may include composites containing oil, tar, tarmac, macadam, tar macadam, asphalt, asphaltum, pitch, bitumen, minerals, rocks, pebbles, gravel, polymeric materials, sand, polyester fibers, Portland cement, petrochemical binders, or the like. Likewise, rejuvenation materials refer to any of various binders, oils, and resins, including bitumen, surfactant, polymeric materials, wax, zeolite, emulsions, asphalt, tar cement, oil, pitch, or the like. Reference to aggregates refers to rock, crushed rock, gravel, sand, slag, sol, cinders, minerals, or other coarse materials, and may include both new aggregates and aggregates reclaimed from an existing road. Surfaces degraded by the present invention may include paved surfaces and/or surfaces of other hard formations.

Figure 1:
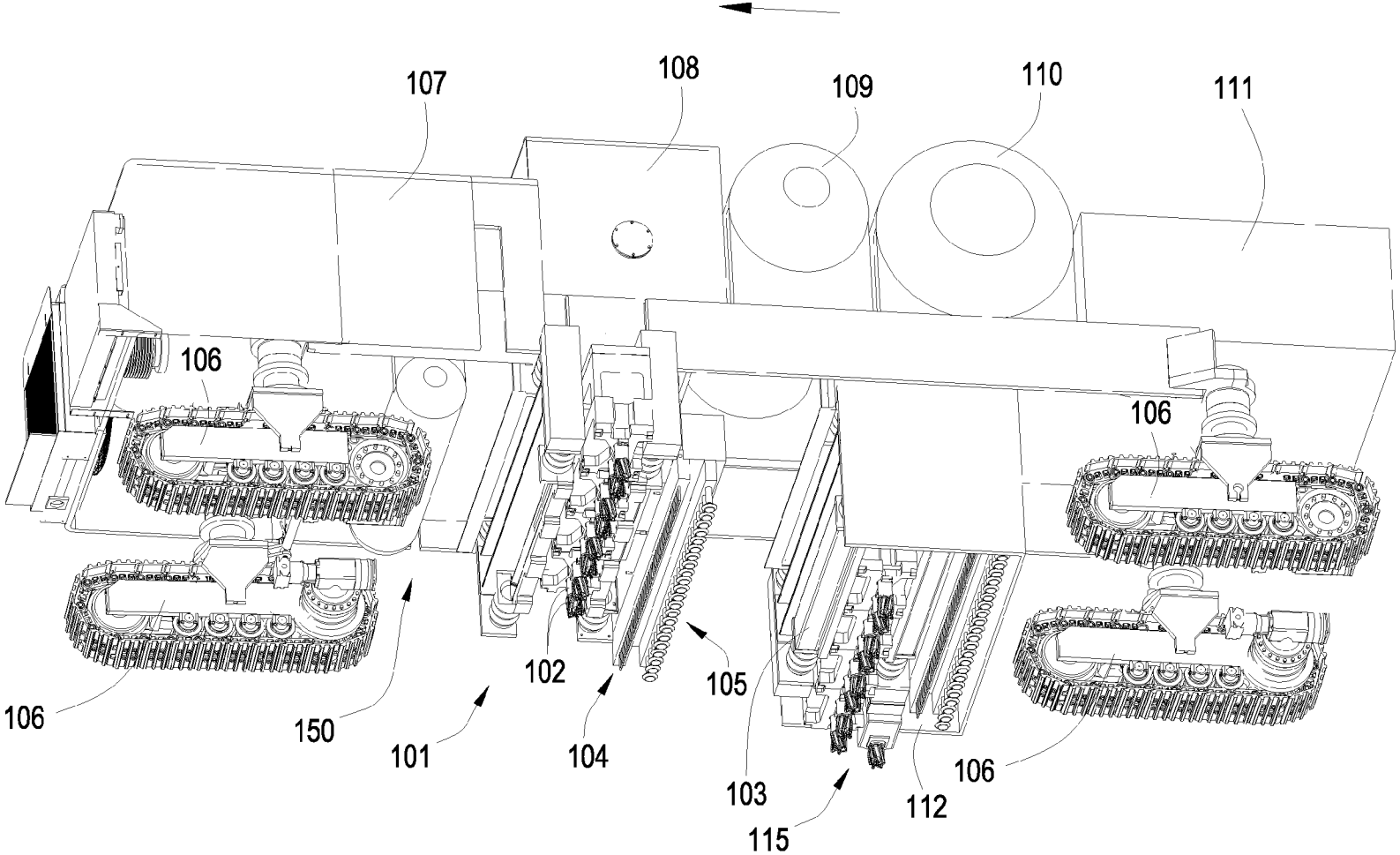
FIG. 1 is a perspective view of an embodiment of a pavement recycling machine.

FIG. 1 is a perspective view of an embodiment of a pavement recycling motorized vehicle 100. The motorized vehicle 100 may be a motor vehicle adapted to degrade, recycle, and reconstruct pavement. The motorized vehicle 100 may comprise at least one carrier 101 slideably attached to its underside 150 to which at least one cylindrical rotary degradation element 102 may be connected by a shaft substantially coaxial with the degradation element's axis of rotation. The carrier 101 may be slideable and adapted to traverse the paved surface.

At least one cylindrical rotary degradation element 102 may comprise an axis of rotation which may be substantially perpendicular to the paved surface. In some embodiments, the axis of rotation may intersect the paved surface at 30 to 150 degrees. A plurality of cutting inserts may be secured to the element's 102 outer surface and at least one cutting insert may comprise a superhard material positioned to contact the surface. The carrier 101 may comprise or be in communication with actuators 103 such as hydraulic cylinders, pneumatic cylinders, or other mechanical devices adapted to move the carrier 101. Each carrier 101 may also comprise a screed 104 to level, smooth, and mix pavement aggregates and/or rejuvenation materials. Additionally, the carrier 101 may comprise a compacting mechanism 105. Such a mechanism 105 may comprise rollers, tampers, tires, or combinations thereof. Additionally, a second carrier 115 may be added to the vehicle 100 which may increase degradation efficiency and speed.

There may also be a shield 112 comprising a first end attached to a carrier 101, 115 and a second end proximate the cylindrical rotary degradation element 102. Although the shield 112 is shown in FIG. 1 with an open side, the shield may form a complete box around all of the elements connected to the carrier. The bottom of the shield 112 may extend until it almost contacts the pavement so as to minimize the possibility that a random piece of aggregate may be projected away from the motorized vehicle. An inside surface of the shield 112 may also comprise a reflective surface which may be useful for maintaining the environment at which the elements degrade pavement within a desired range such as 100 to 275 degrees Fahrenheit. The shield 112 may also be useful for maintaining a reduced or inert environment in which the aggregate and rejuvenation material may be bonded together. The shield 112 may be made of a metal or a heavy fabric.

The motorized vehicle 100 may comprise a translation mechanism 106 such as tracks and/or tires. In some embodiments, each translation mechanism 106 may be adapted to turn enabling the motorized vehicle to maneuvers around sharp corners. The carrier 101 may be between the translation mechanisms 106. The vehicle 100 may also comprise a shroud 107 to cover various internal components such as engine and hydraulic pumps, the carriers 101, 115; the plurality of cylindrical rotary degradation elements 102; or other components. The motorized vehicle 100 may also comprise a tank 108 for storing hydraulic fluid, a fuel tank 109, a tank 110 for storing rejuvenation materials, a hopper 111 for storing aggregate, or combinations thereof.

As the motorized vehicle 100 traverses a paved surface, the plurality of cylindrical rotary degradation elements 102 may be adapted to degrade the paved surface in a direction substantially normal to the paved surface. As the elements 102 rotate and degrade the pavement, they may do so in a manner that dislodges aggregate from the asphalt binder without breaking and/or damaging the aggregate. Additional aggregate and rejuvenation materials may be laid down in front of between, or after the cylindrical rotary degradation elements 102 so that the elements 102 at least partially mix the aggregate, asphalt binder, and rejuvenation materials (collectively referred to as "the mix") together. The screed 104 may then also partially stir the mix in addition to leveling and smoothing it. The compacting mechanism 105 may follow the screed 104 and compact the mix. In this manner old road materials may be recycled and used to lay a new road using a single motorized vehicle 100.

Figure 2:
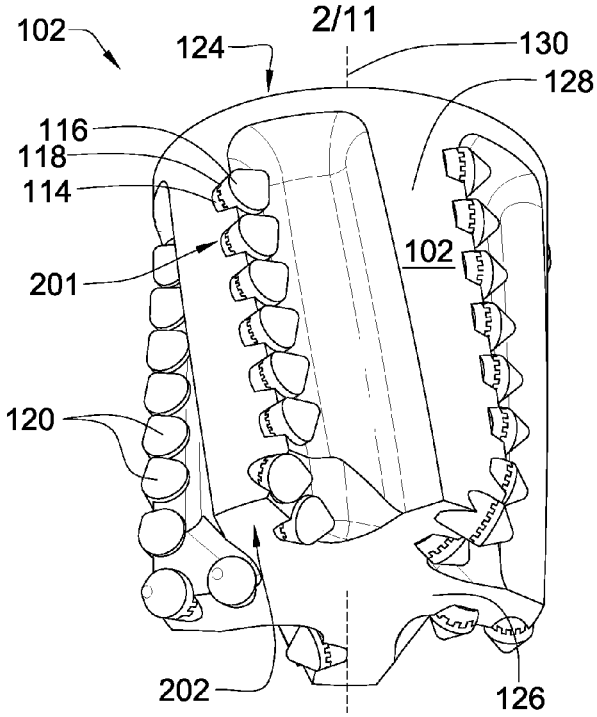
FIG. 2 is a perspective view of an embodiment of a cylindrical rotary degradation element.

Referring now to FIG. 2, a cylindrical rotary degradation element 102 in accordance with the present invention may include a rotary element 102 having a top end 124, a cutting head 126 and a substantially cylindrical surface working 128. The rotary element 102 may be formed from an abrasion resistant material such as high-strength steel, hardened alloys, cemented metal carbide, or any other such material known to those in the art. In certain embodiments, the rotary element 102 may further include a surface coating such as ceramic, steel, ceramic steel composite, steel alloy, bronze alloy, tungsten carbide, or any other heat tolerant, wear resistant surface coating known to those in the art.

A top end 124 of the rotary element 102 may be substantially flat and may be adapted to be rotatably retained by a stationary frame, or by an attachment assembly coupled to a motorized vehicle on wheels or tracks. Alternatively, a top end 124 may assume any shape known to those in the art. A top end 124 may include a radius substantially corresponding to a radius of the cutting head 126, and may reside substantially parallel thereto, such that the rotary element 102 may approximate a round cylinder.

Indeed, a substantially cylindrical working surface 128 may extend between the top end 124 and the cutting head 126 such that each of the top end 124 and cutting head 126 may approximate bases of the rotary element 102. A length of the substantially cylindrical working surface 128 may substantially correspond to rotary element height. The working surface 128 is formed about a rotational axis 130. During operation, the rotational axis 130 may be disposed substantially normal to a paved surface and the rotary element 102 may rotate in a forward or reverse direction about the rotational axis 130 to degrade a surface in a direction substantially normal to such surface. Cutting inserts 201 may be coupled to the substantially cylindrical working surface 128 to facilitate degradation of a paved surface, as discussed in more detail below.

A cutting head 126 of the rotary element 102 may be substantially convex, cone-shaped, pyramidal, flat, or any other shape capable of impacting a paved surface in accordance with the present invention. In some embodiments, a cutting head 126 includes various contours capable of providing mechanical support and effectively distributing mechanical stresses imposed on the rotary element 102 upon impacting a paved surface.

Cutting inserts 201 may be coupled to the cylindrical working surface 128 to facilitate effective degradation. A cutting insert 201 may generally comprise a cemented metal carbide substrate 114 bonded to a superhard material 116 at a non-planar interface 118. The non-planar interface 118 may improve surface attachment between the superhard material 116 and the carbide substrate 114. A non-planar interface 118 may comprise, for example, a convex interface, a concave interface, grooves, nodes, ridges, dimples, a top hat configuration, or any other variety of non-planar physical interfaces. Accordingly, a thickness of the superhard material 116 may vary with respect to a depth of a substrate 114.

In certain embodiments, the substrate 114 and/or superhard material 116 may further comprise a binder-catalyzing material such as cobalt, nickel, iron, a carbonate, or any other metal or non-metal catalyst known to those in the art to facilitate binding the substrate 114 to the superhard material 116. The superhard material may also comprise a 1 to 5 percent concentration of tantalum by weight as a binding agent. Other binders that may be used with the present invention include iron, cobalt, nickel, silicon, hydroxide, hydride, hydrate, phosphorus-oxide, phosphoric acid, carbonate, lanthanide, actinide, phosphate hydrate, hydrogen phosphate, phosphorus carbonate, alkali metals, ruthenium, rhodium, niobium, palladium, chromium, molybdenum, manganese, tantalum or combinations thereof. In some embodiments, the binder is added directly to the superhard material's mixture before the HTHP processing and do not rely on the binder migrating from the substrate into the mixture during the HTHP processing. Certain binding processes in accordance with the present invention, for example, include subjecting a cobalt-containing substrate 114 and a superhard material 116 to high temperature and pressure to cause cobalt to migrate from the substrate 114 to the superhard material 116, thus binding the superhard material 116 to the substrate 114. Where cobalt or other binder-catalyzing material is implemented to facilitate a binding process, however, the binder-catalyzing material may be later leached out of at least a portion of the superhard material 116 to promote the superhard material's ability to resist thermal degradation. For example, impact surfaces 120 of a superhard material 116 bonded to a substrate 114 may be depleted of catalyzing material to improve wear resistance without loss of impact strength, as described in U.S. Pat. No. 6,544,308 to Griffin, incorporated herein by reference.

A superhard material 116 in accordance with the present invention may comprise diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. Superhard material 116 crystals may vary in size to promote wear resistance, impact resistance, or both. In some embodiments the superhard material 116 may be a polycrystalline structure with an average grain size of 1 to 100 microns. In certain embodiments, a superhard material 116 may comprise a material modified to exhibit certain qualities favorable for its use in degradation. For example, in some embodiments a superhard material 116 may comprise thermally stable polycrystalline diamond or partially thermally stable polycrystalline diamond.

In certain embodiments, a substrate 114 may comprise dimensions substantially corresponding to dimensions of the superhard material 116 to facilitate overall cutting insert uniformity. The substrate 114 may be embedded in the substantially cylindrical working surface 128 or may project from the substantially cylindrical working surface 128. The working surface 128 of the degradation element 102 may comprise a plurality of blades 202. The plurality of cutting inserts 201 may be attached to the blades 202, or they may be attached to the rotary degradation element 102 directly. Cutting inserts 201 may be attached to the blades 202 or the degradation element 102 by being brazed or press fit. In FIG. 2 the cutting inserts 201 comprise a substantially conical cross-sectional profile having a pointed impact surface 120. The impact surface 120 may be polished to promote both cutting efficiency and wear resistance. In certain embodiments, the impact surface 120 may be textured or otherwise contoured. The superhard material 116 comprises a substantially pointed geometry.

The degradation elements may be used in a pavement recycling machine as described in FIG. 1, in a milling application, or in a leveling application.

Figure 3:
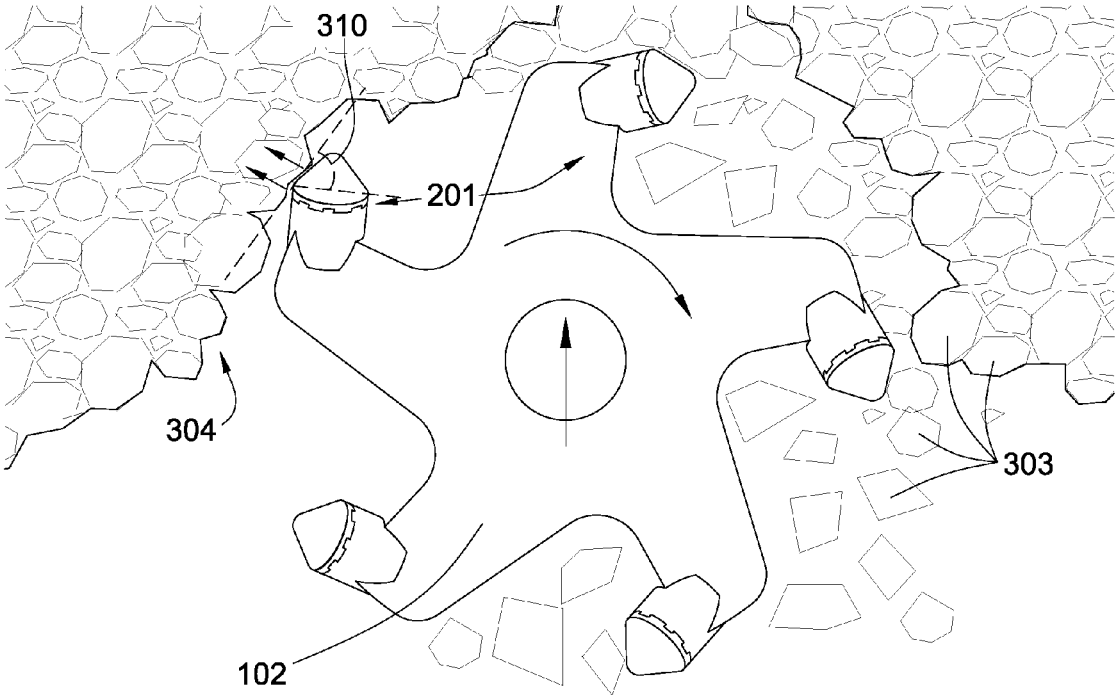
FIG. 3 is an orthogonal view of an embodiment of a rotary degradation element.

FIG. 3 is an orthogonal view of cutting inserts 201 angularly engaging pavement at an incline. The incline may be a negative rake angle 310. A negative rake angle may enable the cutting insert 201 to dislodge a piece of aggregate 303 from the binder without cutting the piece of aggregate 303. The cutting insert 201 may push the aggregate 303 further into the pavement 304 upon an initial contact which may help break the bonds between the aggregate 303 and the binder. Upon successive contacts, the aggregate may be loosened until they are finally dislodged and pushed free from the pavement 304. Dislodging aggregate 303 in this manner may reduce the need to add additional aggregate 303 in order to maintain a proper aggregate size distribution in the mix.

Figure 4:
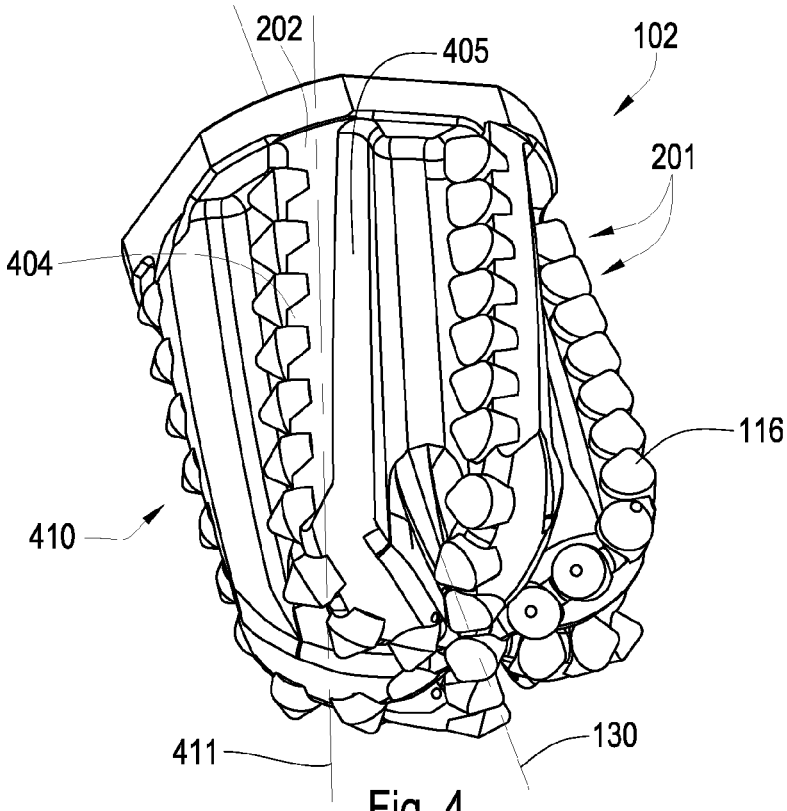
FIG. 4 is a perspective view of another embodiment of a cylindrical rotary degradation element.
Figure 5:
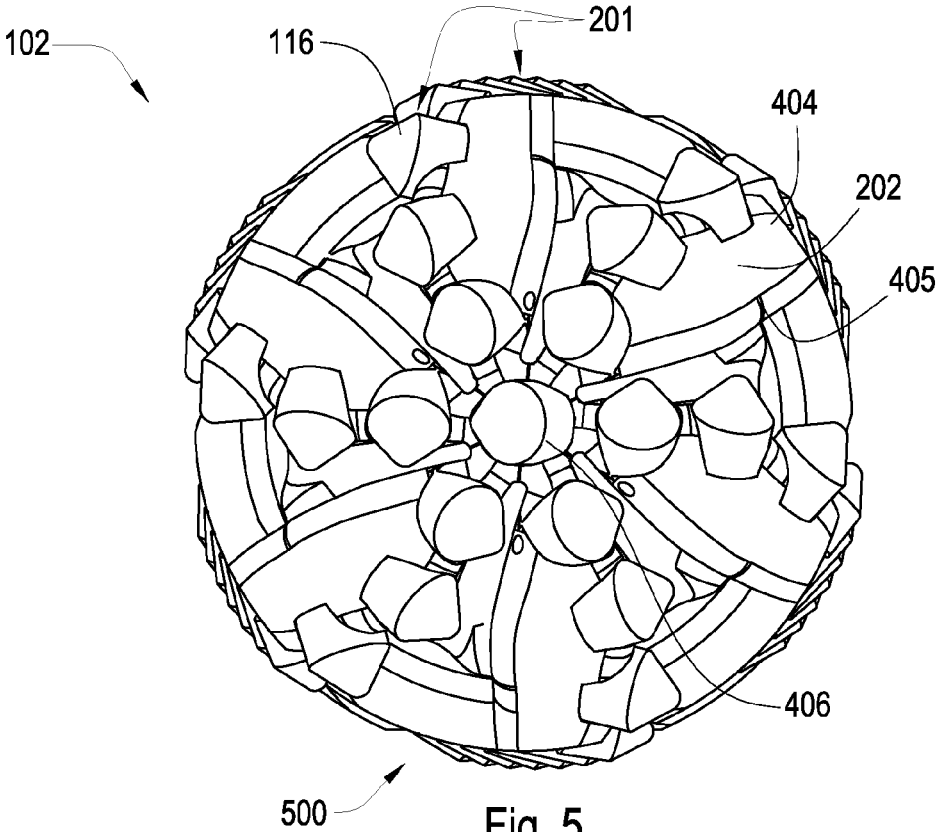
FIG. 5 is an orthogonal view of another embodiment of a cylindrical rotary degradation element.

FIGS. 4 and 5 are perspective views of an embodiment of a cylindrical rotary degradation element 102. Referring to FIG. 4, a side perspective view of an embodiment or a cylindrical rotary degradation element is presented. The cylindrical rotary degradation element 102 may comprise a plurality of cutting inserts 201 that are secured to the element's outer surface 410, and may be adapted to engage the aggregate and dislodge it without breaking it.

The cutting inserts 201 may be secured to a blade 202 formed in the outer surface 410 of the cylindrical rotary degradation element 102. An axis 411 formed by at least a portion of at least one blade 202 may be offset from the axis of rotation 130 by an angle from 1° to 60°. The offset may tilt with or against a direction of rotation. At least one of the cutting inserts 201 may be positioned on an anterior side 404 of the blade 403 and another cutting insert 401 may be positioned on a posterior side 405 of the blade 403. The cutting inserts 201 may be brazed to a blade at an incline, specifically an incline that will result in the superhard material 116 contacting the formation at a negative rake angle.

Referring to FIG. 5, a bottom perspective view of an embodiment of a cylindrical rotary degradation element 102 is disclosed. At least one bottom cutting insert 406 may be positioned in a bottom end 500 of the cylindrical rotary degradation element where a plurality of blades 202 converges. A bottom cutting insert 406 may be beneficial in degrading the pavement when the cylindrical rotary degradation element 102 is plunged into the pavement rather than relying on the weight of the element 102 to break any pavement below its axis. The bottom cutting insert 406 may be positioned perpendicular or parallel to the pavement.

Figure 6:
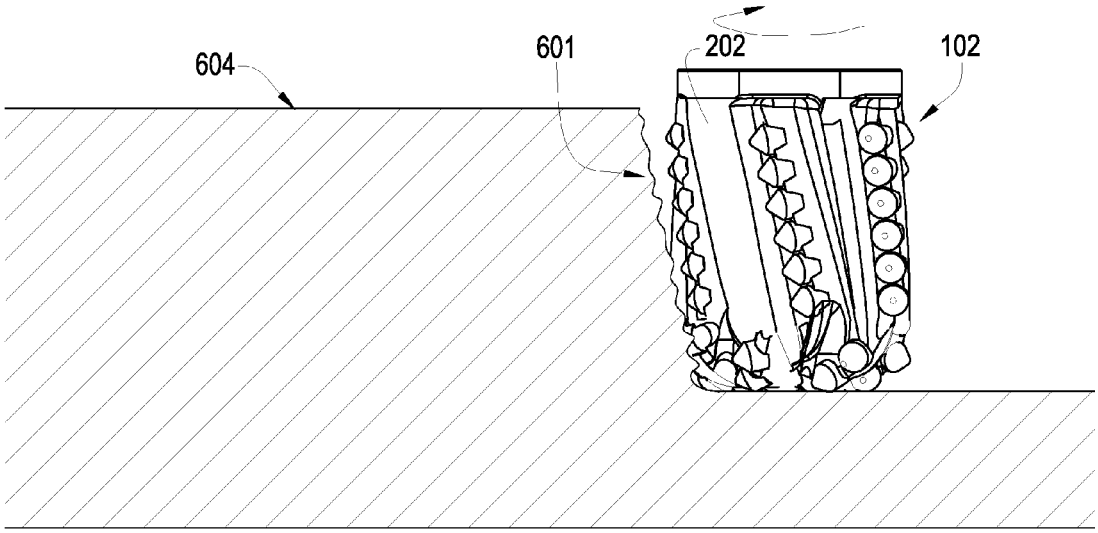
FIG. 6 is an orthogonal view of an embodiment of a cylindrical rotary degradation element degrading a surface.

FIG. 6 is an orthogonal view of an embodiment of a cylindrical rotary degradation element 102 with blades 202 tilted with a direction of rotation. An arrow indicates rotational direction. The cutting inserts 201 of the cylindrical rotary degradation element 102 may engage a pavement 604 at different times depending on the tilt of the blades 202 and the rotational direction. The blades 202 in FIG. 6 are tilted with the direction of rotation such that the cutting inserts 201 at the top of the element 102 will engage the pavement 604 first resulting in a negative slope 601 being formed. Such a negative slope may be beneficial in that the resistance each impact surface 120 meets may be similar throughout the blade 202, which may result in more even wear on the impact surfaces 120.

Figure 7:
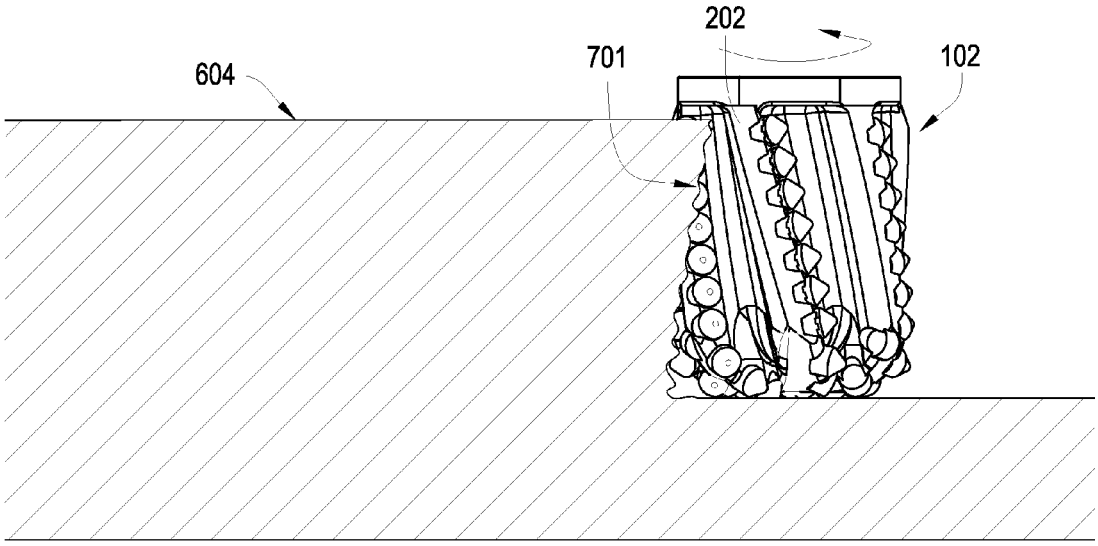
FIG. 7 is an orthogonal view of another embodiment of a cylindrical rotary degradation element degrading a surface.

FIG. 7 is an orthogonal view of an embodiment of a cylindrical rotary degradation element 102 with blades 202 offset behind the axis of rotation. This may result in the cutting inserts 201 at the bottom of the element 102 engaging the pavement 604 first resulting in a positive slope 701 being formed.

Figure 8:
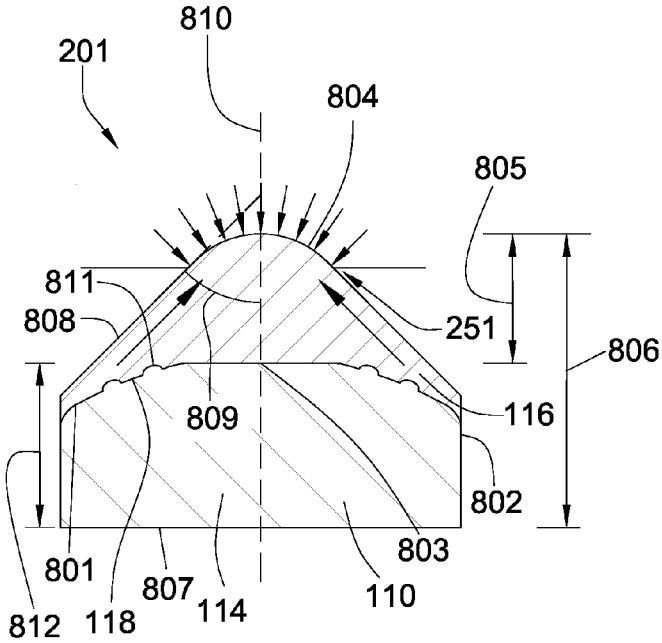
FIG. 8 is cross-sectional diagram of an embodiment of a cutting insert.

Referring now to FIGS. 8-11, cross-sectional views of various insert designs are disclosed. In FIG. 8, the substrate 114 comprises a tapered surface 801 starting from a cylindrical rim 802 of the substrate 114 and ending at an elevated, flatted, central region 803 formed in the substrate 114. The flatted region may comprise a diameter of 0.125 to 0.250 inches. The superhard material 116 comprises a substantially pointed geometry with a sharp apex 804 comprising a radius of 0.050 to 0.125 inches. In some embodiments, the radius may be 0.650 to 0.100 inches. It is believed that the apex 804 is adapted to distribute impact forces across the flatted region 803, which may help prevent the superhard material 116 from chipping or breaking. The superhard material 116 may comprise a thickness 805 of 0.100 to 0.500 inches from the apex to the flatted region or non-planar interface. In some embodiments the thickness 805 may be between 0.125 to 0.300 inches. The substrate may comprise a height 812. The superhard material thickness 805 and the substrate height 812 may together constitute a total thickness 806 of 0.200 to 0.700 inches from the apex 804 to a base 807 of the substrate 114. The sharp apex 804 may allow the high impact resistant element 102 to more easily cleave asphalt, rock, or other formations.

The pointed geometry of the superhard material 116 may comprise a side 808 which forms a 35 to 55 degree angle 809 with a central axis 810 of the insert 201. The angle 809 may be substantially 45 degrees. The included angle may be a 90 degree angle, although in some embodiments, the included angle is 85 to 95 degrees.

The tapered surface of the substrate 114 may incorporate nodules 811 at the interface 118 between the superhard material 116 and the substrate 114, which may provide more surface area on the substrate 114 to provide a stronger interface 118. The interface 118 may also incorporate grooves, dimples, protrusions, reverse dimples, or combinations thereof. The interface 118 may be convex, as in the current embodiment, though in other embodiments the interface 118 may be concave.

Figure 9:
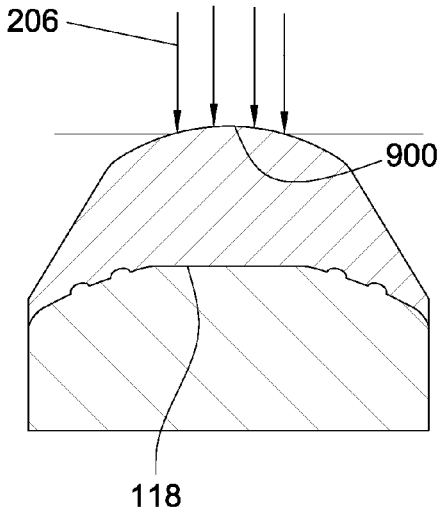
FIG. 9 is cross-sectional diagram of another embodiment of a cutting insert.
Figure 10:
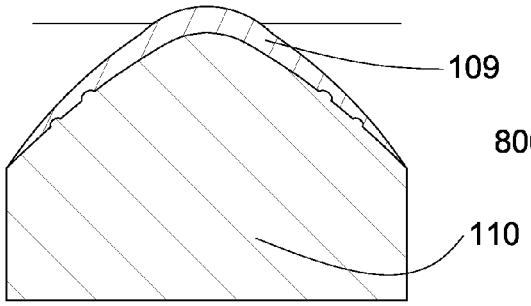
FIG. 10 is cross-sectional diagram of another embodiment of a cutting insert.

Comparing FIGS. 8 and 9, the advantages of having a pointed apex 804 as opposed to a blunt apex 900 may be seen. FIG. 8 is a representation of a pointed geometry which was made by the inventors of the present invention, which has a 0.094 inch radius apex 804 and a 0.150 inch thickness 805 from the apex to the non-planar interface 118. FIG. 9 is a representation of another geometry also made by the same inventors comprising a 0.160 inch radius apex and 0.200 inch thickness 805 from the apex 804 to the non-planar interface 118. The superhard geometries were compared to each other in a drop test performed at Novatek International, Inc. located in Provo, Utah. Using an Instron Dynatup 9250G drop test machine, the tools were secured to a base of the machine and weights comprising tungsten carbide targets were dropped onto the superhard geometries. The pointed apex 804 of FIG. 8 surprisingly required about five times more joules to break than the thicker geometry of FIG. 9.

It was shown that the sharper geometry of FIG. 8 penetrated deeper into the tungsten carbide target, thereby allowing more surface area of the superhard material 116 to absorb the energy from the falling target by beneficially buttressing the penetrated portion of the superhard material 116. This is believed to effectively convert bending and shear loading of the diamond substrate into a more beneficial quasi-hydrostatic type compressive force, thereby drastically increasing the load carrying capabilities of the superhard material 116. On the other hand, since the embodiment of FIG. 9 is blunter, the apex 804 hardly penetrated into the tungsten carbide target thereby providing little buttress support to the diamond substrate and caused the superhard material 116 to fail in shear/bending at a much lower load with larger surface area using the same grade of diamond and carbide. The average embodiment of FIG. 8 broke at about 130 joules while the average geometry of FIG. 9 broke at about 24 joules. It is believed that since the load was distributed across a greater surface area in the embodiment of FIG. 8, it was capable of withstanding a greater impact than that of the thicker embodiment of FIG. 9.

Surprisingly, in the embodiment of FIG. 8 when the superhard geometry finally broke, the crack initiation point 251 was below the radius. This is believed to result from the tungsten carbide target pressurizing the flanks of the pointed geometry in the penetrated portion, which results in the greater hydrostatic stress loading in the pointed geometry. It is also believed that since the radius was still intact after the break, that the pointed geometry will still be able to withstand high amounts of impact, thereby prolonging the useful life of the pointed geometry even after chipping.

Three different types of pointed insert geometries were tested by Novatek, International, Inc. The first type of geometry is disclosed in FIG. 10, and comprises a 0.035 inch thick superhard geometry and an apex with a 0.094 inch radius. This type of geometry broke in the 8 to 15 joules range. The blunt geometry disclosed in FIG. 9 with the radius of 0.160 inches and a thickness of 0.200, which the inventors believed would outperform the other geometries broke in the 20-25 joule range. The pointed geometry disclosed in FIG. 8 with the apex having a 0.094 inch radius and the 0.150 inch thickness broke at about 130 joules. The impact force measured when the superhard geometry with the 0.160 inch radius broke was 75 kilo-newtons. Although the Instron drop test machine was only calibrated to measure up to 88 kilo-newtons, which the pointed geometry exceeded when it broke, the inventors were able to extrapolate that the pointed geometry probably experienced about 105 kilo-newtons when it broke.

In the prior art, it was believed that a sharp radius of 0.075 to 0.125 inches of a superhard material 116 such as diamond would break if the apex were too sharp, thus rounded and semispherical geometries are commercially used today. As can be seen, superhard material 116 having the features of being thicker than 0.100 inches and having the feature of a 0.075 to 0.125 inch radius greatly increase the wear resistance of the superhard material 116.

The performance of the present invention is not presently found in commercially available products or in the prior art. Inserts 201 tested between 5 and 20 joules have been acceptable in most commercial applications, but not suitable for drilling very hard rock formations After the surprising results of the above test, Finite Element Analysis (FEA) was performed. Both the embodiments disclosed in FIGS. 8 and 9 broke at the same stress, but due to the geometries of the superhard material 116, that VonMises level was achieved under significantly different loads in the different embodiments because the pointed apex 804 distributed the stresses more efficiently than the blunt apex 900. In embodiments where the stress is concentrated near the apex, the stress is both larger and higher in bending and shear, while the stress in a pointed geometry is distributed lower and more efficiently due to a hydrostatic nature. Since high and low stresses are concentrated in the superhard material, transverse rupture is believed to actually occur in the superhard material, which is generally more brittle than the softer carbide substrate.

Figure 11:
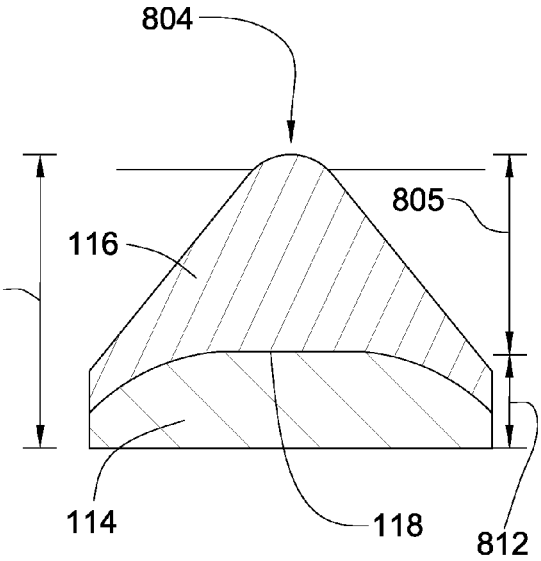
FIG. 11 is cross-sectional diagram of another embodiment of a cutting insert.

FIG. 11 discloses an embodiment of an insert 201 comprising a maximum substrate height 812 that is less than one-half the total thickness 806 of the insert. The superhard material comprises a thickness 805 of 0.275 inches and a sharp apex 804 comprising a radius of 0.075 inches. In some embodiments of the invention a volume occupied by the superhard material 116 may be 75 to 150 percent of a volume occupied by the carbide substrate 114.

FIGS. 12 through 19 disclose various possible embodiments comprising different combinations of tapered surfaces 801 and impact surfaces 120. The substantially pointed geometry of the superhard material 116 may comprise a convex or a concave side. FIG. 12 illustrates the pointed geometry with a concave side 450 and a continuous convex substrate geometry 451 at the interface 801. FIG. 13 comprises an embodiment of a thicker superhard material 550 from the apex to the non-planar interface, while still maintaining a radius of 0.075 to 0.125 inches at the apex. FIG. 14 illustrates grooves 650 formed in the substrate 114 to increase the strength of interface 118. FIG. 15 illustrates a slightly concave geometry at the interface 118 with concave sides 750. FIG. 16 discloses slightly convex sides 850 of the pointed geometry while still maintaining the 0.075 to 0.125 inch radius. FIG. 17 discloses a flat sided pointed geometry 950. FIG. 118 discloses concave and convex portions 1050, 1051 of the substrate 114 with a generally flatted central portion.

Now referring to FIG. 19, the superhard material 116 may comprise a convex surface comprising different general angles at a lower portion 1100, a middle portion 1101, and an upper portion 1102 with respect to the central axis of the tool. The lower portion 1100 of the side surface may be angled at substantially 25 to 33 degrees from the central axis, the middle portion 1101, which may make up a majority of the convex surface, may be angled at substantially 33 to 40 degrees from the central axis, and the upper portion 1102 of the side surface may be angled at about 40 to 50 degrees from the central axis.

Figure 20:
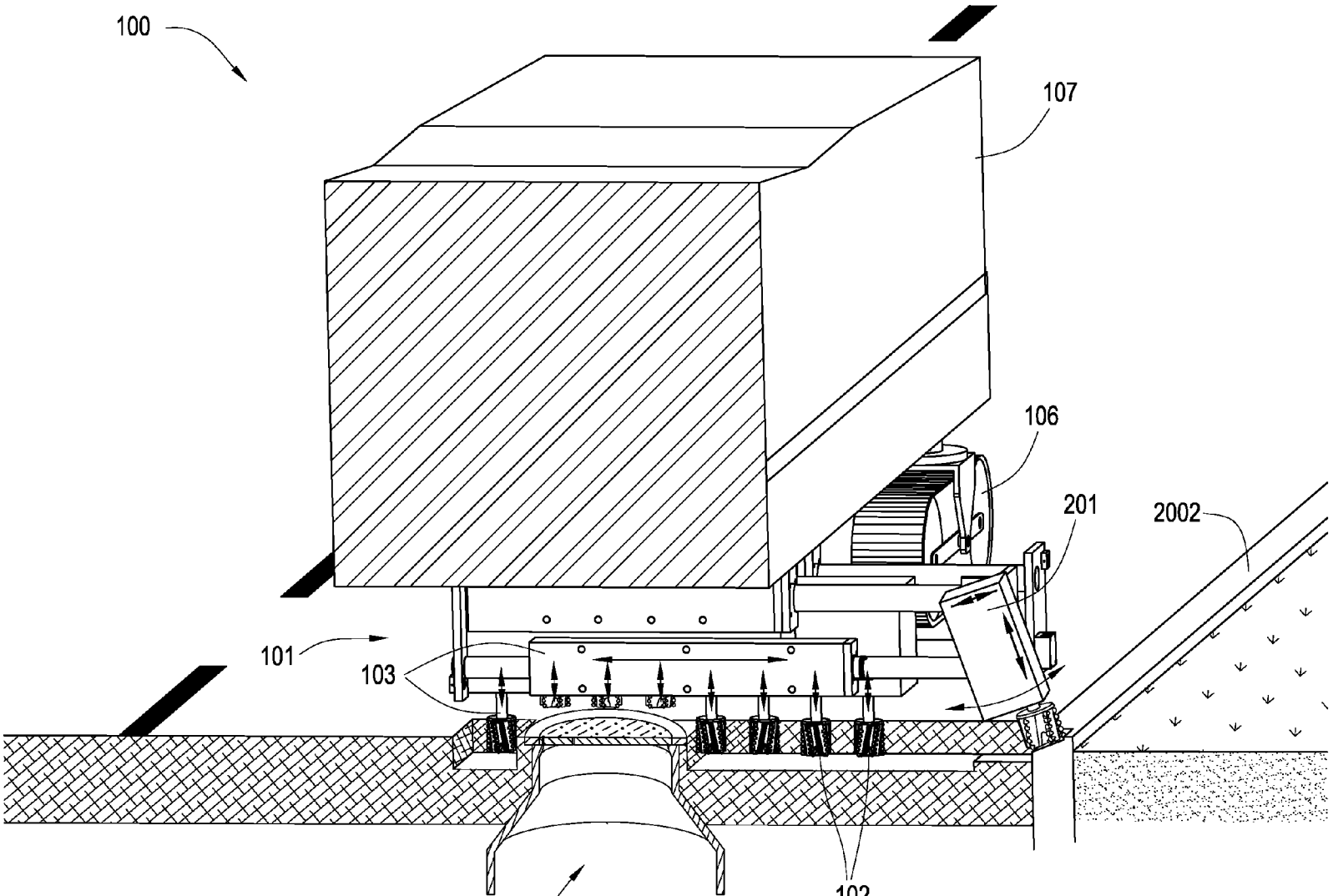
FIG. 20 is a perspective view of an embodiment of a surface degradation machine.

FIG. 20 is a cutaway perspective view showing vertical movement of the cylindrical rotary degradation elements 102, and the contemplated movements of the carrier 101 and cylindrical rotary degradation elements 102. Obstacles, including manholes 2001, utility boxes, utility access points, sensors, curbs 2002, or combinations thereof, may sometimes be in the way when degrading, recycling, leveling, and reconstructing a road. Some machines may need to stop degrading or recycling until the machine has advanced beyond the obstacle. Other machines may pave over the obstacle which workers may later uncover. The cylindrical rotary degradation elements 102, however, may be capable of vertical movement which may enable the elements 102 that would engage the obstacle to rise until they have passed over the obstacle while the other elements 102 continue to degrade around the obstacle. The elements 102 may be capable of more movement other than just vertical movement. An element 102 may be in communication with an actuating mechanism 103 adapted to move the cylindrical rotary degradation element 102 in a horizontal, vertical, transverse, diagonal, and pivotal direction independent of and relative to the vehicle 100. In some embodiments, only an ⅛ of an inch may be removed, as may be common in leveling applications.

A mounting member may be adapted for independent movement relative to a motorized vehicle or stationary frame to which it is mounted. In this manner, the mounting member may enable more than one degradation apparatus to move as a unitary set in a direction independent of the motorized vehicle or stationary frame. A mounting member, for example, may be displaced from a motorized vehicle or stationary frame in any of a vertical, horizontal, diagonal, transverse or pivotal direction, or a combination thereof.

A mounting member may be operatively connected to an actuating mechanism. In certain embodiments, the actuating mechanism selected to induce independent movement of the mounting member may also function to induce rotational movement and/or independent directional movement of at least one individual degradation apparatus attached to the mounting member.

More than one mounting member may be mounted to a motorized vehicle, each acting either independently or cooperatively with each other. In certain embodiments, for example, a pair of mounting members may be attached in parallel beneath a motorized vehicle to the vehicle chassis. The mounting members may substantially correspond to a mid-section of the vehicle to prevent vehicular imbalance as well as to avoid interference with one or more vehicular tires or tracks. The mounting members and/or individual degradation apparatuses retained thereby may be selectively vertically elevated to clear a paved surface during vehicular travel.

Figure 21:
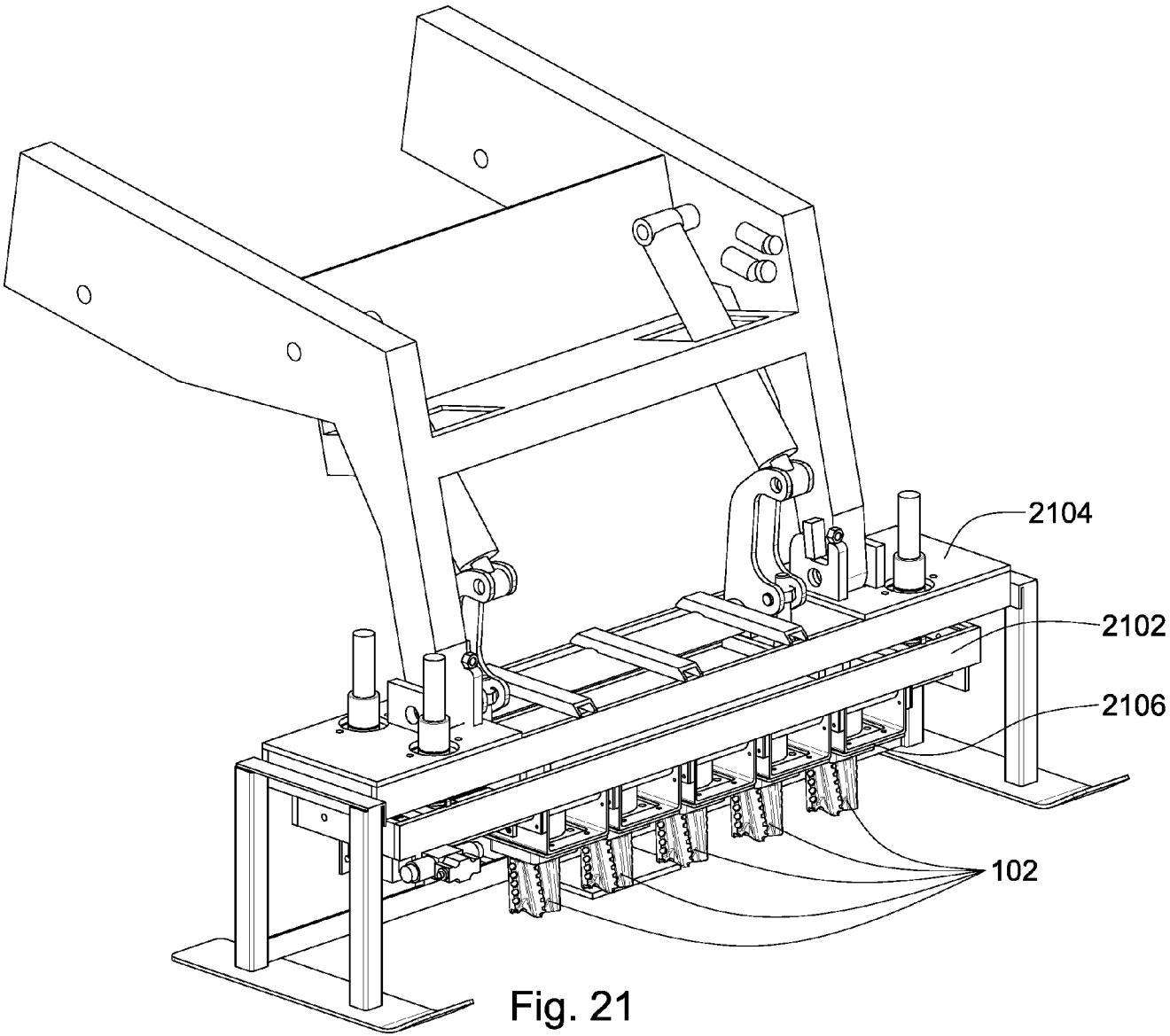
FIG. 21 is a perspective view of an embodiment of an attachment assembly.

Referring now to FIG. 21, in certain embodiments, a surface degradation apparatus may include one or more mounting members 2102 integral to an attachment assembly 2104, where each mounting member 2102 is capable of rotatably retaining a plurality of degradation elements 102. A mounting member 2102 may be adapted for independent movement relative to a motorized vehicle 100 or stationary frame to which it is mounted. In this manner, the mounting member 2102 may enable more than one cylindrical rotary degradation element 102 to move as a unitary set in a direction independent of the motorized vehicle 100 or stationary frame. A mounting member 2102, for example, may be displaced from a motorized vehicle 100 or stationary frame in any of a vertical, horizontal, diagonal, transverse or pivotal direction, or a combination thereof. A mounting member 2102 may be operatively connected to an actuating mechanism. In certain embodiments, the actuating mechanism selected to induce independent movement of the mounting member 2102 may also function to induce rotational movement and/or independent directional movement of at least one individual cylindrical rotary degradation element 102 attached to the mounting member 2102.

In one embodiment, a mounting member 2102 comprises a longitudinal arm capable of linearly retaining a plurality of degradation apparatuses 100. The arm may include a plurality of retaining apertures 2106, where each retaining aperture 2106 corresponds to a cylindrical rotary degradation element 102. A retaining aperture 2106 may be adapted to permit rotational movement of the cylindrical rotary degradation element 102 retained thereby. Furthermore, in certain embodiments the retaining aperture 2106 may enable independent vertical, horizontal, diagonal, transverse, or pivotal movement of its corresponding cylindrical rotary degradation element 102

Figure 22:
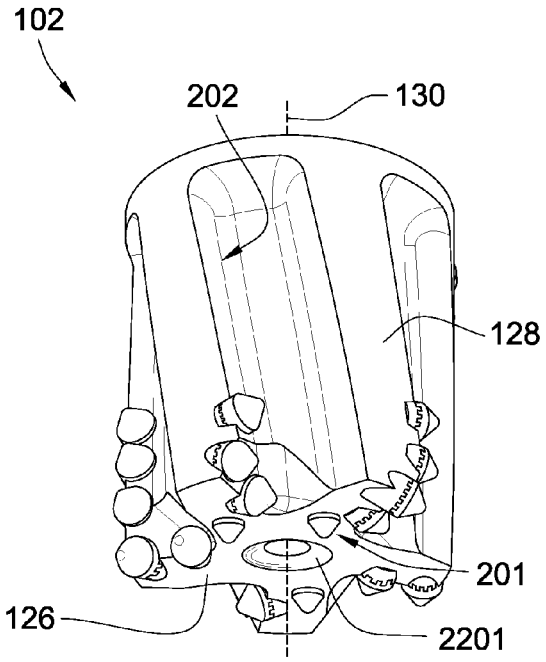
FIG. 22 is a perspective view of another embodiment of a cylindrical rotary degradation element.

Referring now to FIG. 22, a substantially cylindrical rotary degradation element 102 comprises a recess 2201 in the cutting head 126 proximate the rotational axis 130. A plurality of cutting inserts 201 are disposed on the cutting head 126 and are coaxial with the degradation element 102. Cutting inserts 201 are also disposed along a portion of the cylindrical working surface 128. In the present embodiment the working surface 128 comprises a plurality of blades 202.

Figure 23:
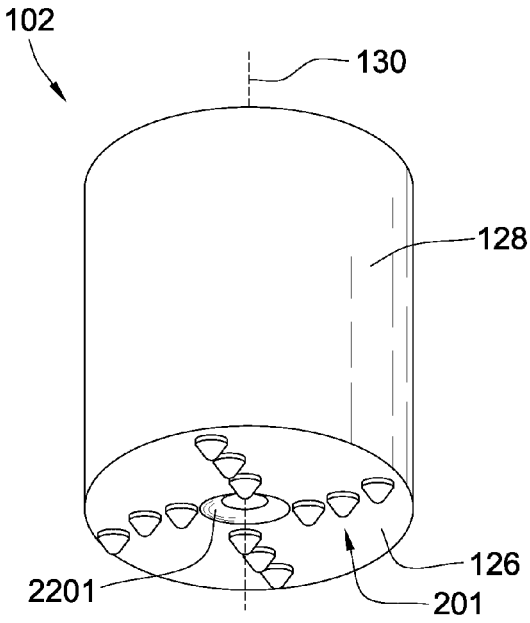
FIG. 23 is a perspective view of another embodiment of a cylindrical rotary degradation element.
Figure 23A:
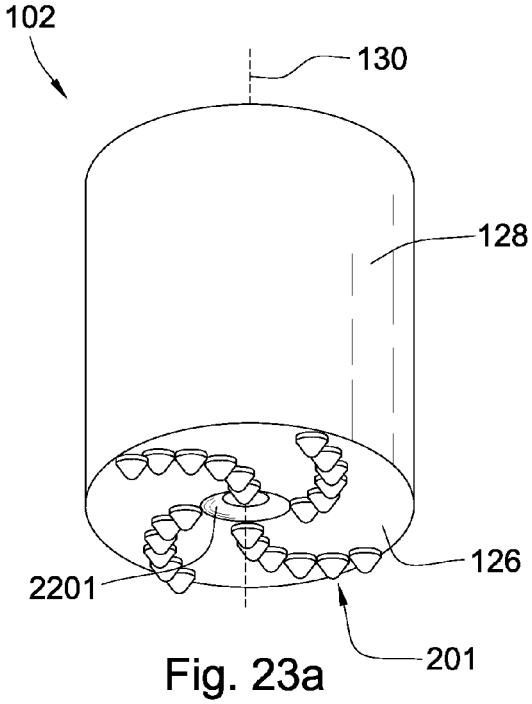
FIG. 23*a* is a perspective view of another embodiment of a cylindrical rotary degradation element.
Figure 23B:
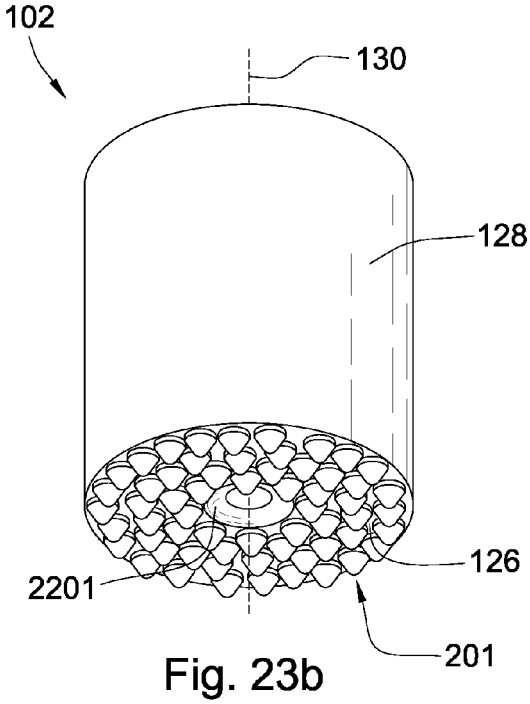
FIG. 23*b* is a perspective view of another embodiment of a cylindrical rotary degradation element.

FIG. 23 discloses an embodiment of a cylindrical rotary degradation element 102 comprising a substantially continuous cylindrical working surface 128 without blades 202. Although the cutting inserts 201 are disposed only on the cutting head 126, in some embodiments cutting inserts 201 may also be disposed on the working surface 128 either exclusively or in combination with those on the cutting head 126. The embodiment in FIG. 23 also comprises the recess 2201 proximate the rotational axis 130. In some embodiments, there is no recess. FIGS. 23*a* and 23*b* disclose other embodiments of cylindrical rotary degradation elements 102.

Figure 24:
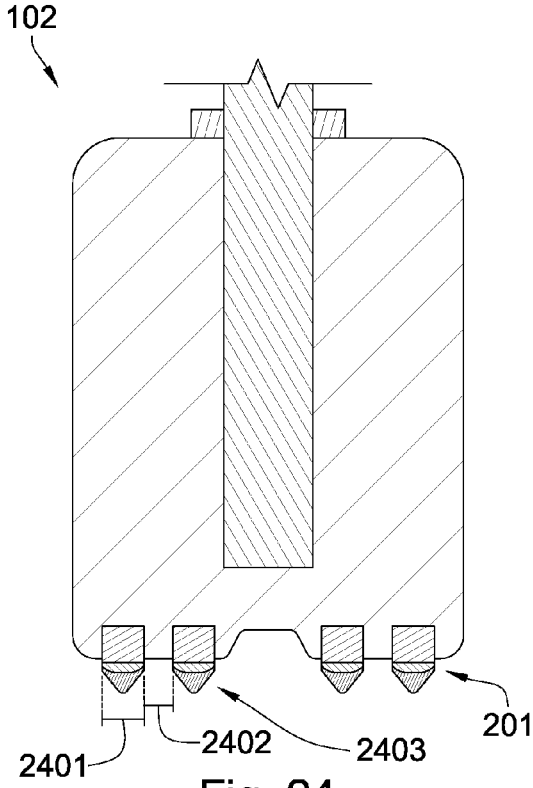
FIG. 24 is a cross-sectional view of another embodiment of a cylindrical rotary degradation element.
Figure 25:
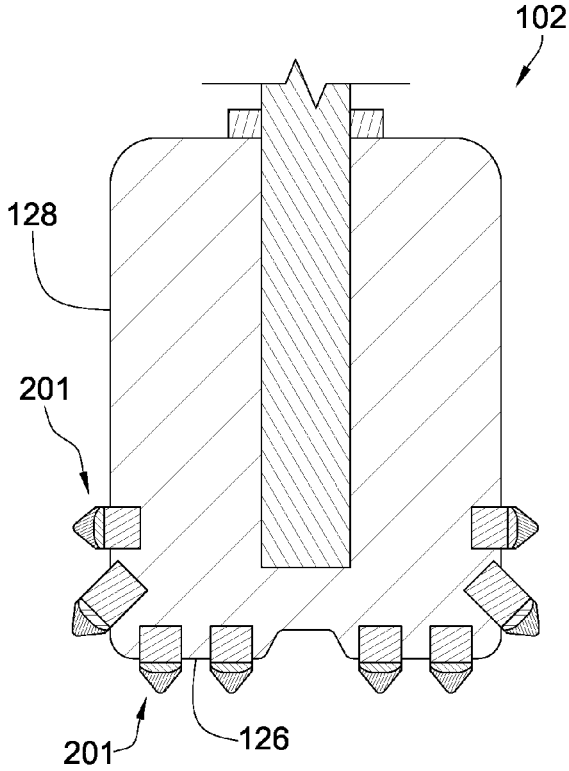
FIG. 25 is a cross-sectional view of another embodiment of a cylindrical rotary degradation element.
Figure 26:
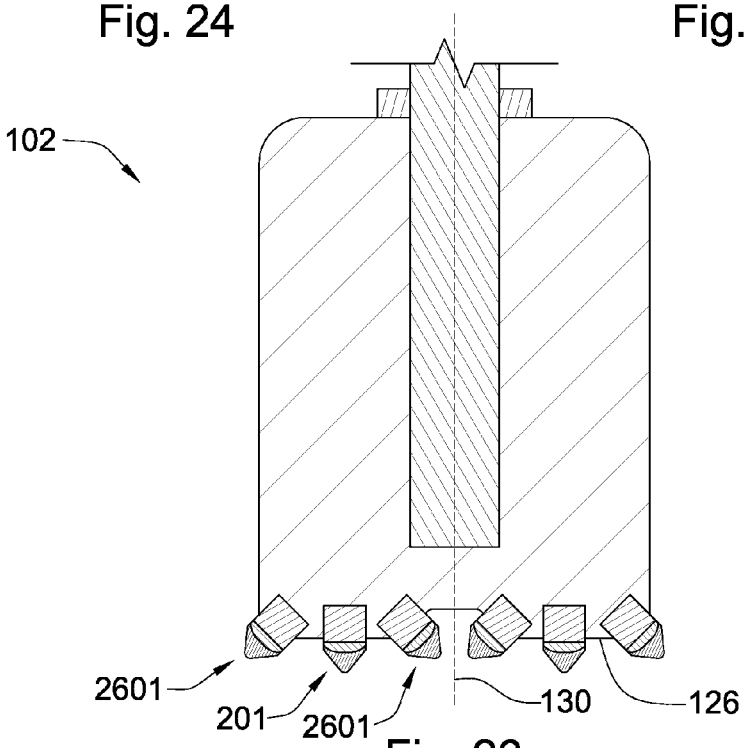
FIG. 26 is a cross-sectional view of another embodiment of a cylindrical rotary degradation element.

Referring now to FIGS. 24-26, cross-sectional views disclose embodiments of rotary degradation elements 102. FIG. 24 discloses an insert 201 comprising a diameter 2401 and being disposed within a distance 2402 from a second insert 2403 that is less than the diameter 2401 of the insert 201. FIG. 25 discloses a cylindrical rotary degradation element 102 comprising inserts 201 disposed both on the cutting head 126 and on the cylindrical working surface 128. FIG. 26 discloses angled inserts 2601 disposed on the cutting head 126 wherein the angled inserts are not coaxial with the degradation element 102.

Figure 27:
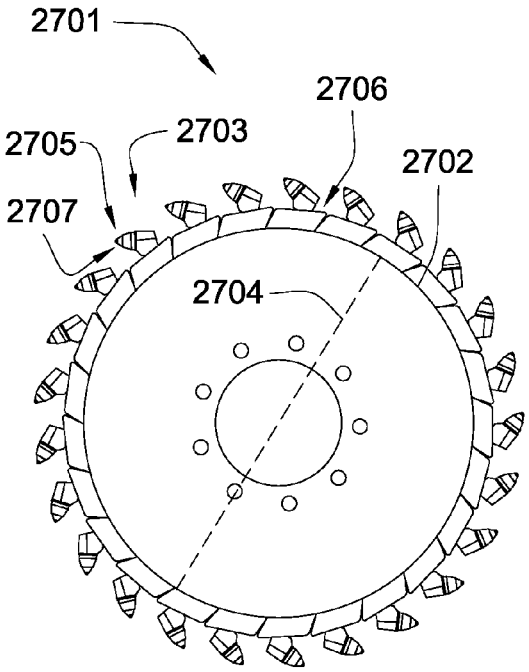
FIG. 27 is an orthogonal view of an embodiment of a degradation drum.
Figure 28:
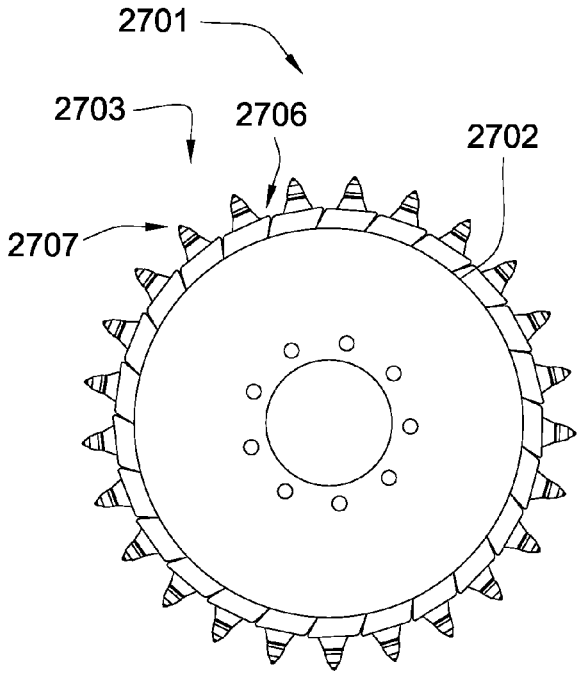
FIG. 28 is an orthogonal view of another embodiment of a degradation drum.
Figure 29:
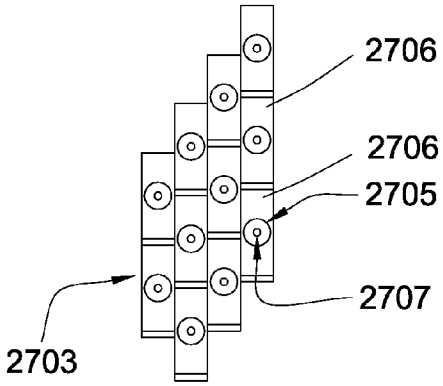
FIG. 29 is a orthogonal view of an embodiment of a plurality of degradation assemblies.

Referring now to FIGS. 27 and 28, embodiments of degradation drums 2701 are disclosed that are consistent with the present invention. A degradation drum 2701 comprises a generally cylindrical body 2702 comprising a plurality of degradation assemblies 2703 disposed on an outer diameter 2704 of the body 2701. The degradation assemblies 2703 each comprise a pick 2705 that has a shank disposed in a holder 2706. Each assembly 2703 also comprises an impact tip 2707 opposite the shank. In the present embodiment the shank is obscured by the holder 2706. The impact tip comprises a superhard material 116 bonded to a metal carbide substrate 114 at a non-planar interface 118. The superhard material 116 comprises a substantially pointed geometry with an apex 804 comprising a 0.050 to 0.160 inch radius and a 0.100 to 0.500 inch thickness 805 from the apex 804 to the non-planar interface 118. The holder 2706 of each of the plurality of degradation assemblies 2703 contacts the holder 2706 of at least one other assembly 2703. FIG. 29 discloses a plurality of degradation assemblies 2703 with the holder 2706 of each assembly 2703 contacting the holder 2706 of at least one other assembly 2703. The placement of impact tips 2707 close together is believed to facilitate fine-tooth milling operations in which paved surfaces may be smoothed and/or leveled instead of completely degraded. The use of inserts 201 comprising a substantially pointed geometry with an apex comprising a 0.050 to 0.160 inch radius and a 0.100 to 0.500 inch thickness from the apex to the non-planar interface may further facilitate fine-tooth milling. In some embodiments of the invention the inserts 201 may protrude into the surface being degraded to a depth that is less than the thickness 805 of the superhard material 116. In such embodiments milling debris may be substantially excluded from contact with the rest of the degradation assembly 2703 by the shallowness of the protrusion of the inserts 201 into the surface. This may result is less wear on the degradation assembly 2703.

Whereas the present invention has been described in particular relation to the drawings attached hereto, it should be understood that other and further modifications apart from those shown or suggested herein, may be made within the scope and spirit of the present invention.

What is claimed is:

1. An apparatus for directional degradation of a surface, comprising:

an attachment assembly connected to a motorized vehicle comprising at least one degradation tool;

the at least one degradation tool comprising a substantially cylindrical rotary degradation element having a substantially cylindrical working surface formed about a rotational axis;

a plurality of cutting inserts embedded within the substantially cylindrical working surface and adapted to degrade a surface in a direction substantially normal to the rotational axis;

at least one of the plurality of cutting inserts comprising a superhard material bonded to a cemented metal carbide substrate at a non-planar interface;

the superhard material comprising a substantially pointed geometry with an apex comprising a 0.050 to 0.160 inch radius and a 0.100 to 0.500 inch thickness from the apex to the non-planar interface; and at least two degradation tools being adapted for independent movement relative to the attachment assembly.

2. The apparatus of claim 1, wherein the superhard material comprises a 0.125 to 0.300 inch thickness from the apex to the non-planar interface.

3. The apparatus of claim 1, wherein the superhard material and the substrate comprise a total thickness of 0.200 to 0.700 inches from the apex to a base of the substrate.

4. The apparatus of claim 3, wherein the substrate comprises a maximum height from the base to the non-planar interface that is less than one-half of the total thickness from the apex to the base.

5. The insert of claim 1, wherein the superhard material comprises a substantially conical surface having a side which forms a 35 to 55 degree angle with a central axis of the insert.

6. The apparatus of claim 5, wherein the angle is substantially 45 degrees.

7. The apparatus of claim 1, wherein the substantially pointed geometry comprises a convex side.

8. The apparatus of claim 1, wherein the substantially pointed geometry comprises a concave side.

9. The apparatus of claim 1, wherein the substrate comprises a tapered surface at the interface starting from a cylindrical rim of the substrate and ending at an elevated flatted central region formed in the substrate.

10. The apparatus of claim 9, wherein the flatted region comprises a diameter of 0.125 to 0.250 inches.

11. The apparatus of claim 1, wherein the superhard material is diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

12. The apparatus of claim 1, wherein each of the plurality of inserts comprises a substrate diameter and each insert is within a distance equal to its own substrate diameter to at least one other insert.

13. The apparatus of claim 1, wherein a volume of the superhard material is 75 to 150 percent of a volume of the carbide substrate.

14. The apparatus of claim 1, wherein the insert is brazed or press fit to the degradation element.

15. The apparatus of claim 1, wherein the substrate is attached to blades formed on the outer surface of the cylindrical rotary degradation element.

16. The apparatus of claim 1, wherein the working surface is adapted to angularly contact the surface to be degraded at a negative rake angle.

17. The apparatus of claim 16, wherein the negative rake angle is from 0.1° to 60°.

18. The apparatus of claim 1, wherein the rotary degradation element is attached to the vehicle by a shaft substantially coaxial with a central axis of the degradation element.

19. The apparatus of claim 1, wherein the rotary degradation element is in communication with an actuating mechanism adapted to move the rotary degradation element in an horizontal, vertical, transverse, diagonal and pivotal direction relative to the motorized vehicle.

* * * * *